US011156338B2

(12) United States Patent
Murata et al.

(10) Patent No.: US 11,156,338 B2
(45) Date of Patent: Oct. 26, 2021

(54) LAMP UNIT, VEHICLE LAMP, AND METHOD FOR MANUFACTURING LAMP UNIT

(71) Applicant: KOITO MANUFACTURING CO., LTD., Tokyo (JP)

(72) Inventors: Yoshimasa Murata, Shizuoka (JP); Takuya Serita, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 16/962,315

(22) PCT Filed: Jan. 11, 2019

(86) PCT No.: PCT/JP2019/000614
§ 371 (c)(1),
(2) Date: Jul. 15, 2020

(87) PCT Pub. No.: WO2019/142725
PCT Pub. Date: Jul. 25, 2019

(65) Prior Publication Data

US 2020/0340641 A1 Oct. 29, 2020

(30) Foreign Application Priority Data

Jan. 19, 2018 (JP) ..... JP2018-007287

(51) Int. Cl.
*F21S 45/47* (2018.01)
*F21S 41/19* (2018.01)
*F21S 43/19* (2018.01)

(52) U.S. Cl.
CPC ..... *F21S 45/47* (2018.01); *F21S 41/192* (2018.01); *F21S 43/195* (2018.01)

(58) Field of Classification Search
CPC ..... F21S 45/47; F21S 41/192; F21S 43/195; F21S 43/14; F21S 41/141; F21V 29/503; F21V 23/06; F21V 29/70
See application file for complete search history.

(56) References Cited

U.S. PATENT DOCUMENTS

2008/0117647 A1* 5/2008 Behr ..... F21V 29/70 362/547
2016/0153636 A1* 6/2016 Shiraishi ..... F21S 43/195 362/549

(Continued)

FOREIGN PATENT DOCUMENTS

CN 104868870 A 8/2015
JP 2012-074186 A 4/2012

(Continued)

OTHER PUBLICATIONS

International Search Report dated Apr. 2, 2019 for WO 2019/142725 A1 (3 pages).

*Primary Examiner* — Kevin Quarterman
(74) *Attorney, Agent, or Firm* — Abelman, Frayne & Schwab

(57) ABSTRACT

A lamp unit includes a light source, and a socket on which the light source unit is mounted. The socket includes a light source holder that holds the light source, and a connector that supplies power to the light source, and the light source holder includes a recess extending along a light source unit mounting surface from an outside to a portion immediately below the light source.

12 Claims, 9 Drawing Sheets

(56) References Cited

U.S. PATENT DOCUMENTS

| | | | | |
|---|---|---|---|---|
| 2016/0215948 | A1* | 7/2016 | Helbig | F21S 43/195 |
| 2016/0290621 | A1* | 10/2016 | Ozawa | F21S 43/14 |

FOREIGN PATENT DOCUMENTS

| | | | |
|---|---|---|---|
| JP | 2013-247061 | A | 12/2013 |
| JP | 2016-195098 | A | 11/2016 |

* cited by examiner

LAMP UNIT, VEHICLE LAMP, AND METHOD FOR MANUFACTURING LAMP UNIT

CROSS REFERENCE TO RELATED APPLICATIONS

This application is a national phase of PCT application No. PCT/JP2019/000614, filed on 11 Jan. 2019, which claims priority from Japanese patent application No. 2018-007287, filed on 19 Jan. 2018, all of which are incorporated herein by reference.

TECHNICAL FIELD

The present invention relates to a lamp unit and a vehicle lamp, and a method for manufacturing the lamp unit, and particularly, relates to a lamp unit and a vehicle lamp that utilizes a light emitting element as a light source.

BACKGROUND

In recent years, vehicle lamps using a light emitting element such as a light emitting diode (LED) have been distributed. Accompanying the distribution of the vehicle lamps, there is a need for replacing a necessary part at the time of maintenance. In response to the need, for example, as disclosed in Patent Document 1, a lamp unit (a light source unit) in which a light source part mounted with a light emitting element has been proposed. Specifically, the lamp unit includes a light source including a light emitting element and a printed wiring board on which the light emitting element is mounted, a socket that fixes the light source, and a heat radiation member such as a metal plate that is brought into contact with the light source. Since the light emission efficiency of the light emitting element tends to decrease as the temperature of the light emitting element itself increases, a heat radiation member such as an aluminum plate is brought into contact with the light source unit to radiate the heat of the light emitting element, and a temperature rise is suppressed. Then, in the vehicle lamp, the light source unit of the lamp unit is inserted into a lamp body from outside the lamp body, and the light emitting element of the light source part is positioned at a predetermined position of a reflecting mirror to implement a desired light distribution.

PRIOR ART DOCUMENT

Patent Document

Patent Document 1: Japanese Laid-Open Patent Publication No. 2013-247061

SUMMARY OF THE INVENTION

Problem to be Solved

However, in the lamp unit, the socket has a complicated shape, for example, provided with heat radiation fins so as to increase the surface area in order to increase the heat radiation efficiency. As a result, the socket unit is formed to be integrated with the heat radiation member by injection molding a heat conductive resin in a state where the heat radiation member is disposed at a predetermined position. At the time of injection molding, since the heat conductive resin shrinks as it is cured, some extent of deformation and distortion of the shape of the socket unit are generated due to the shrinkage. In some cases, the position of the heat radiation member was shifted due to the deformation and the distortion. When the position of the heat radiation member is shifted, the position of the light source unit to be mounted is also shifted, and thus, the light is not distributed in a desired direction.

Further, the lamp unit is provided with a connector extending in the socket from the outer surface of the socket toward the light source, and an electrical connection to the light source is secured by connecting the connector and a wire harness. The light source unit disclosed in Patent Document 1, the connector portion has a structure in which the connector extends straight from a rear surface of the socket to the light source. In other words, the connector extends in the same direction as the mounting direction of the light source, and, for example, the heat radiation fin also extends in the same direction as the connector.

However, depending on a location of the lamp body, a sufficient space may not be secured on the rear surface of the lamp body, or the wire harness may not be wired to the rear surface of the socket. In this case, a connecting port of the connector of the lamp unit is formed to be positioned on the side surface of the socket, instead of the rear surface. Therefore, the connector having a cylindrical shape extending in the socket unit extends in a direction different from the mounting direction of the light source. For example, the heat radiation fin may extend from the side surface of the socket in a direction different from the mounting direction of the light source, so as to follow the direction in which the connector extends. For example, the extending direction may be orthogonal to the mounting direction of the light source.

As described above, when, for example, the connector or the heat radiation fin extends from the side surface of the socket in a direction different from the mounting direction of the light source, the following event may occur at the time of the injection molding of the socket. That is, a protruding portion of the mold of the socket that forms a gap in the connector portion or between the heat radiation fins is not positioned orthogonal to the light source unit mounting portion of the metal plate serving as the heat radiation member. Then, at the time of injection molding, the back surface of the metal plate may not be pressed by the mold, which is not desirable in fixing the metal plate. Specifically, when the connector or the heat radiation fin in the related art extends in the same direction as the mounting direction of the light source, the mold for creating a space in the connector portion or a gap between the heat radiation fins is brought into contact with the back surface of the metal plate, and the metal plate is pressed from both the front surface and the back surface, together with the mold the presses the light source unit mounting surface of the metal plate, and thus, the metal plate is hardly shifted. Meanwhile, in the socket having a structure in which the connector extends in a direction different from the mounting direction of the light source, even when the light source unit mounting surface of the metal plate is pressed by a mold, the back surface of the metal plate is not supported by anything, and thus, the metal plate may not be pressed from both two sides. As a result, a socket in which the position of the metal plate is shifted due to the pressure at the time of injection molding may be formed. In this case, the light source mounted on the metal plate is also shifted, and thus, the light distribution direction of the light emitting element may not be appropriate.

Therefore, the present disclosure has been made in consideration of the above circumstances in the related art, and is to provide, in a socket-type lamp unit, a lamp unit that suppresses a light distribution failure due to deformation of the socket unit and a vehicle lamp including the lamp unit, and a method for manufacturing the lamp unit that suppresses the light distribution failure due to the deformation of the socket.

Means to Solve the Problem

In order to solve the above problems, a lamp unit according to the present disclosure includes: a light source, and a socket on which the light source is mounted. The socket includes a light source holder that holds the light source, and a connector that supplies power to the light source, and the light source holder includes a recess extending along a light source mounting surface from an outside to immediately below the light source.

When forming the socket, a portion immediately below the light source holding portion is supported by a mold configured to form the recess, and with the support, the occurrence of positional deformation of the light source holder is suppressed. As a result, the light source mounted on the light source holder may suppress the light distribution direction from being shifted.

Further, in an aspect of the present disclosure, the light source holder includes a housing made of a heat conductive resin, and a metal plate embedded in the housing, the light source is mounted on a surface of the metal plate that is partially exposed from the housing, and the recess extends along a back surface of the metal plate.

Since the recess extends along the back surface of the metal plate, and the back surface of the metal plate does not have a heat conductive resin, the metal plate is not affected by deformation due to shrinkage of the heat conductive resin at the time of molding, and thus, the positional shifting and deformation of the metal plate when manufacturing the connector portion may be suppressed.

Further, in an aspect of the present disclosure, the back surface of the metal plate is exposed in the recess.

Further, in an aspect of the present disclosure, a width of the recess in a direction parallel to the metal plate and different from a direction in which the recess is extending is in a range of 35% or more and 70% or less with respect to a width of the metal plate in the same direction.

Further, in an aspect of the present disclosure, the connector extends in a first direction intersecting the mounting direction of the light source unit in the socket.

Further, in an aspect of the present disclosure, the direction in which the recess extends is substantially the same as the first first direction.

Further, in an aspect of the present disclosure, the first direction a direction orthogonal to the mounting direction of the light source.

Further, in an aspect of the present disclosure, a filling member is disposed in the recess.

Further, a method for manufacturing a lamp unit according to the present disclosure includes: an outer shape preparing step of preparing an outer shape mold to form an outer shape of a light source holder and a socket; a recess preparing step of preparing a recess mold extending to a portion immediately below a mounting surface of the light source holder; a filling step of filling an inside of the outer shape mold with a heat conductive resin; and a curing step of curing the heat conductive resin.

Further, the method according to the present disclosure includes a metal plate preparing step of disposing the metal plate inside the outer shape mold. In the recess preparing step, the recess mold may be brought into contact with a back surface of the metal plate.

Effect of the Invention

In the present disclosure, in a socket-type lamp unit, a lamp unit that suppresses a light distribution failure due to deformation of a socket and a vehicle lamp including the lamp unit may be provided.

BRIEF DESCRIPTION OF THE DRAWINGS

FIG. 8A is a view illustrating a terminal holding portion 17 in the related art, and FIG. 8B is a view illustrating the terminal holding portion 17 of the second embodiment;

FIG. 10A is a view illustrating an example of the protruding portion, and FIG. 10B is a view illustrating another example of the protruding portion.

DETAILED DESCRIPTION TO EXECUTE THE INVENTION

First Embodiment

Figure 1:
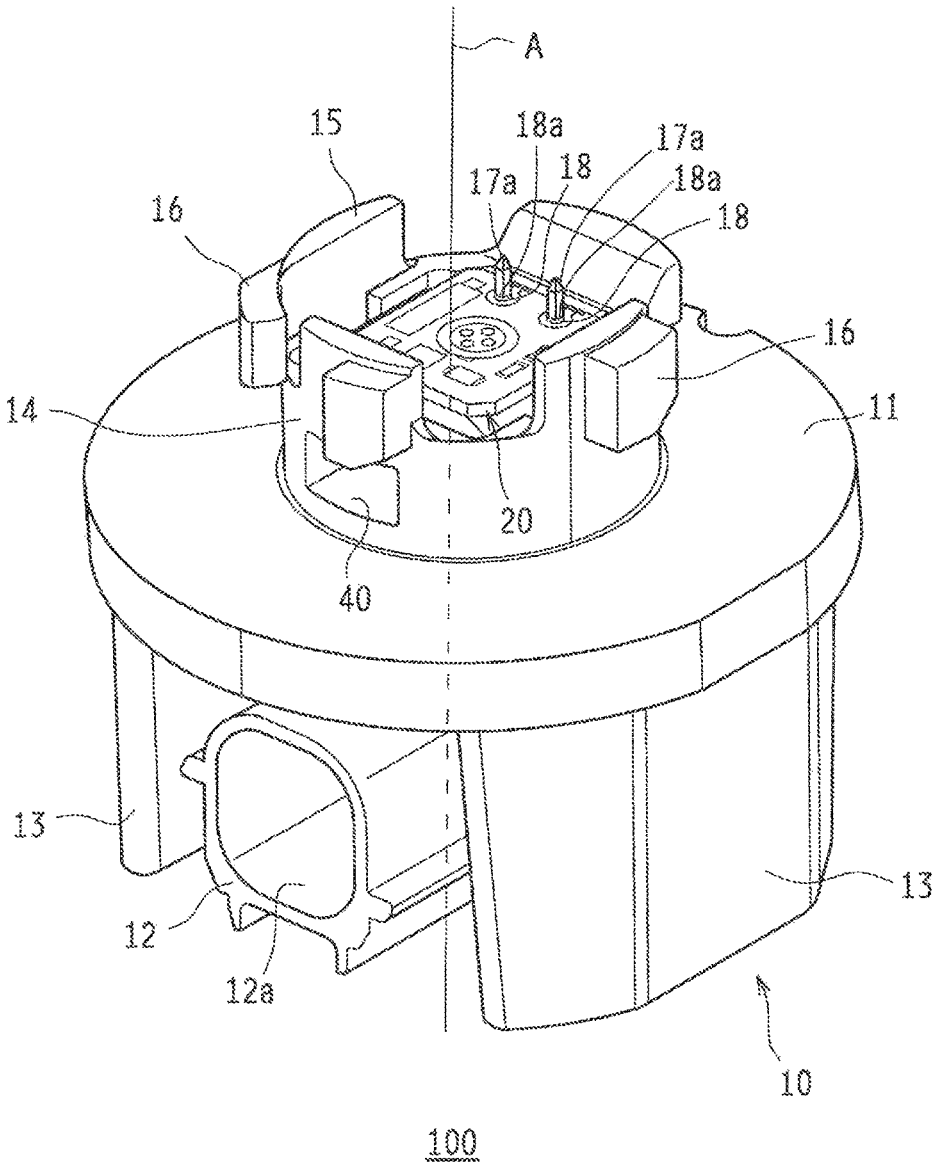
FIG. 1 is a schematic perspective view illustrating a lamp unit 100 of a first embodiment.
Figure 2:
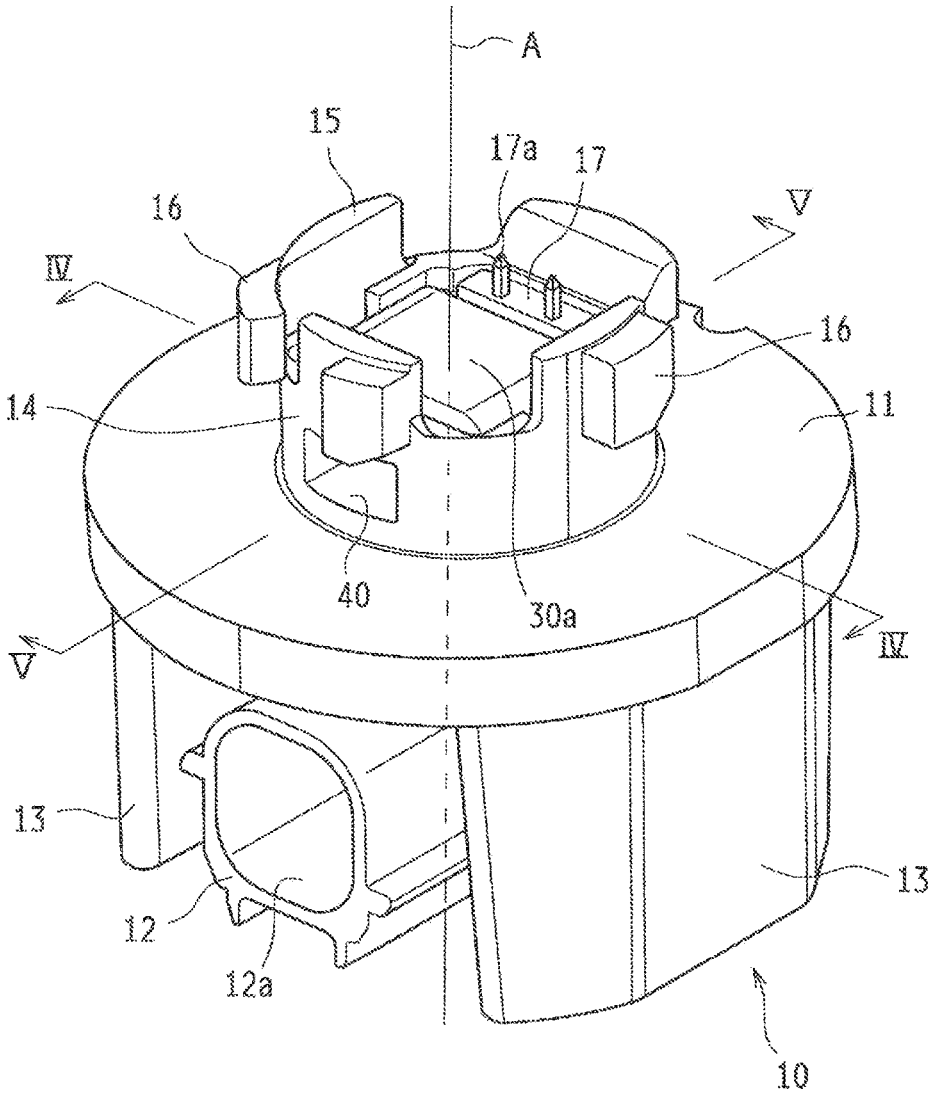
FIG. 2 is a schematic perspective view illustrating the lamp unit 100 of the first embodiment in a state where a light source unit 20 is separated.
Figure 3:
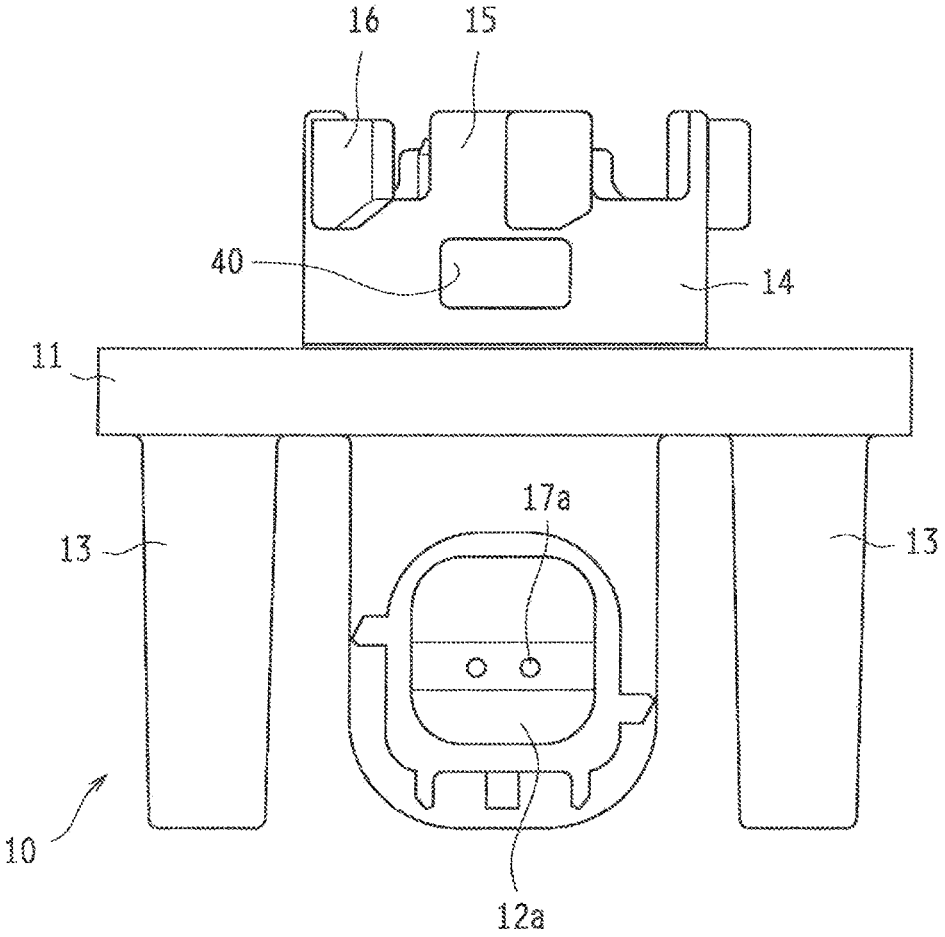
FIG. 3 is a schematic side view illustrating the lamp unit 100 in FIG. 2 with the light source 20 separated.
Figure 4:
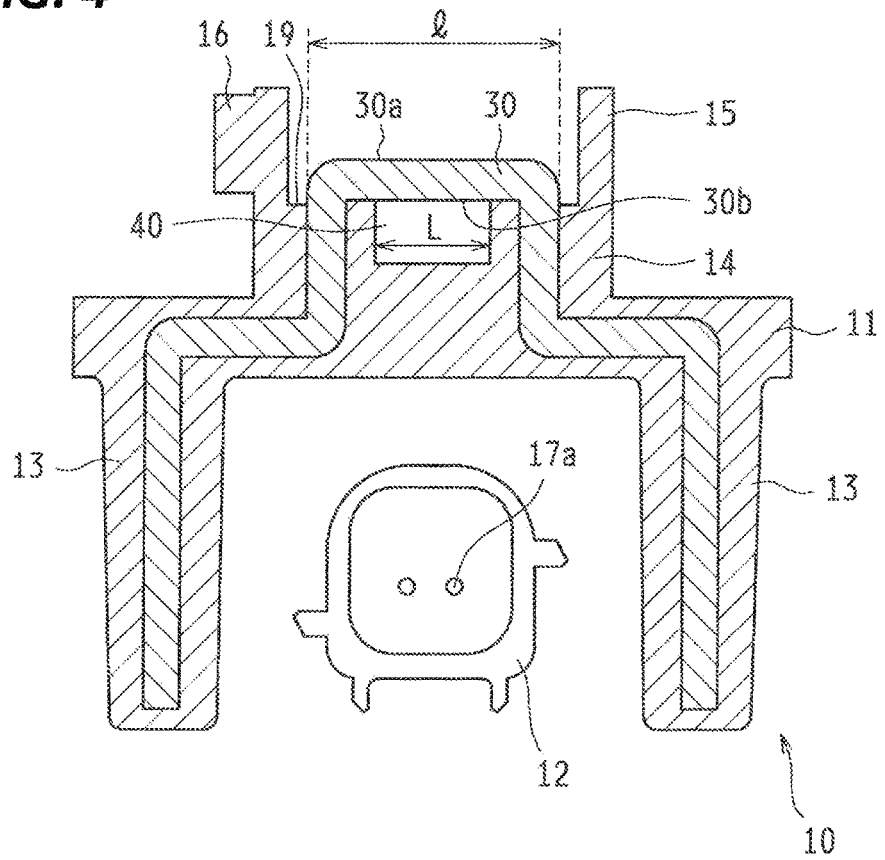
FIG. 4 is a schematic cross-sectional view taken along line IV-IV in FIG. 2.
Figure 5:
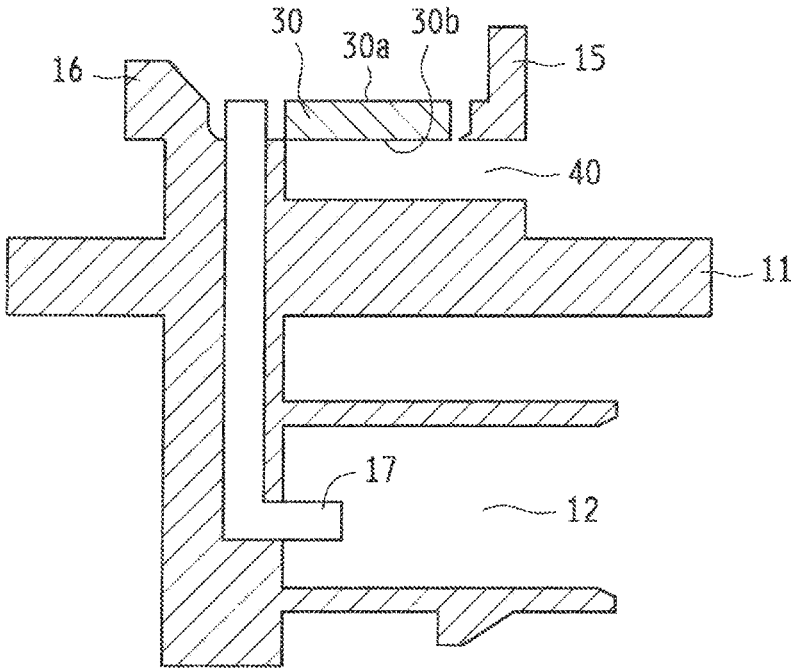
FIG. 5 is a schematic cross-sectional view taken along line V-V in FIG. 2.

Hereinafter, embodiments of the present disclosure will be described with reference to the drawings. Identical or corresponding components, members, and processes in each of the drawings will be denoted by the same symbols, and overlapping descriptions thereof will be appropriately omitted. FIG. 1 is a schematic perspective view illustrating a lamp unit 100 of the present embodiment, FIG. 2 is a schematic perspective view illustrating the lamp unit 100 with a light source unit separated, FIG. 3 is a schematic side view, and FIGS. 4 and 5 are schematic cross-sectional views.

As illustrated in FIG. 1, the lamp unit 100 includes a socket unit 10 and a light source unit 20.

The socket unit 10 is a member that holds the light source unit 20, performs heat radiation of the light source unit 20, secures electrical connection to the light source unit 20 from the outside, and is attached to a lamp body (not illustrated). As illustrated in FIG. 1, the socket unit 10 includes a flange portion 11, a connector portion 12, heat radiation fins 13, and a light source holding portion 14. A plurality of side walls 15 and engaging portions 16 are formed in the light source holding portion 14. Further, a terminal holding portion 17 and terminals 17*a* are exposed adjacent to the light source unit 20, and the terminals 17*a* and the light source unit 20 are electrically connected to each other.

A material that constitutes a housing of the socket unit 10 is not limited as long as it has a good heat conductivity, but it is desirable to use an aluminum die cast or a heat conductive resin. When carbon fiber is contained in the heat conductive resin, it has a high heat conductance and a good conductivity, and when ceramic fillers such as $Al_2O_3$, AlN, and BN are contained, it has a high heat conductance and a good electrical insulation. Both cases are particularly desirable because they are lightweight.

The flange portion 11 is a portion having a substantially disk shape, and the light source holding portion 14 is provided upright on the main surface, and the connector portion 12 and the heat radiation fins 13 are formed on the back surface. The main surface on which the light source holding portion 14 is formed is a surface that is brought into contact with the lamp body side when attaching to the lamp body, and the insertion of the light source unit 20 into the lamp body is restricted by the flange portion 11. Here, the flange portion 11 having a substantially disk shape is illustrated, but other shapes may be used as long as they have a flat shape, and a notch or a projection may be provided for, for example, positioning.

The connector portion 12 is provided on the back surface of the flange portion 11, and a wire harness (not illustrated) is connected thereto from the outside. As illustrated in FIGS. 1 to 5, the connector portion 12 has a cylindrical shape having an inner diameter capable of accommodating a connector on the wire harness side, and the terminal holding portion 17 and the terminals 17*a* are exposed inside the connector portion 12. When the wire harness side connector is inserted into the connector portion 12, the terminals 17*a* and the wire harness are electrically connected, and power and signals are supplied to the lamp unit 100 form outside.

As illustrated in FIGS. 2, 3, and 5, the connector portion 12 has a cylindrical shape that is extending in a direction intersecting an axis A that is a mounting direction of the light source unit 20 in the light source holding portion 14 (to be described later), and an inserting port 12*a* into which the wire harness is inserted is opened in a direction different from the axis A. In the present embodiment, the connector portion 12 extends from the inserting port 12*a* in a direction substantially orthogonal to the axis A. As illustrated in FIG. 5, the terminal holding portion 17 (to be described later) holds a plurality of terminals 17*a*, and extends in the socket unit 10 in the direction of the axis A. Then, the end portion of the terminal holding portion 17 is in contact with the connector portion 12 in the socket unit 10. As described above, with the inserting port 12*a* of the connector portion 12 opened on the side surface of the socket unit 10, even when mounting the lamp unit 100 in a location where the space for mounting the lamp unit 100 is not sufficient, so that it is difficult for a operator to put into his/her hand, or in a location where the wire harness may not be wired to the rear surface of the lamp body (not illustrated), electrical connection with the wire harness may be easily performed.

As illustrated in FIGS. 1 to 5, the heat radiation fins 13 are a plurality of columnar portions provided upright over the substantially entire area of the back surface of the flange portion 11 where the connector portion 12 is not formed. The plurality of heat radiation fins 13 include one extending along the outer shell of the socket unit 10 in the direction of the axis A, and one (not illustrated) extending parallel to the connector portion 12. A gap is provided between the adjacent heat radiation fins 13 to increase the surface area per volume of the heat radiation fin 13 to improve heat radiation property. Further, the shape of the heat radiation fin 13 is a long-plate shape, but is not limited thereto, and may be various shapes such as a rod shape or a corrugated plate shape. Further, convection of air easily occurs in the gap provided between the heat radiation fins 13, and thus, further improvement in heat radiation property may be expected. The direction in which the heat radiation fin 13 is extending may be any direction other than the direction of the axis A, and the direction parallel to the connector portion 12.

The light source holding portion 14 is a substantially cylindrical portion provided upright from the main surface of the flange portion 11, and the light source unit 20 is mounted on the upper surface thereof. As illustrated in FIG. 1, the light source holding portion 14 and the flange portion 11 are arranged so that the centers thereof coincide with each other to be a concentric circle. The light source holding portion 14 may be have a diameter capable of accommodating the light source unit 20 therein, and as illustrated in FIG. 1, the four corners of the light source unit 20 may be located on the outer periphery of the light source holding portion 14 from the viewpoint of miniaturization. The height from the main surface of the flange portion 11 to the upper surface 19 on which the light source unit 20 is mounted is designed to be the insertion depth into the lamp body.

The side wall 15 is a cylindrical outer peripheral portion extending to surround the periphery of the light source unit 20 at the upper end of the light source holding portion 14, and the light source unit 20 is accommodated and positioned inside the plurality of side walls 15. The engaging portion 16 is a projection formed intermittently at the upper end of the outer periphery of the light source holding portion 14. When an insertion hole having a shape corresponding to the outer shape of the light source holding portion 14 is formed in the lamp body, and the lamp unit 100 is inserted into the insertion hole and is rotated, the lamp unit 100 is fixed with the lamp body sandwiched between the engaging portion 16 and the main surface of the flange portion 11.

The terminal holding portion 17 is a portion made of an insulating resin and holding a plurality of terminals 17*a*. The terminal 17*a* is a rod-shaped member made of a metal having a good conductivity, and the plurality of terminals 17*a* are integrated with the insulating resin of the terminal holding portion 17. As illustrated in FIGS. 1 and 2, one end of the terminal holding portion 17 and the terminals 17*a* is exposed on the upper surface of the light source holding portion 14 adjacent to the light source unit 20. Further, as illustrated in FIG. 5, the terminal holding portion 17 extends in the socket unit 10 through the light source holding portion 14 and the flange portion 11 in the direction parallel to the axis A, and is brought into contact with the connector portion 12 that is extending in the socket unit in the same manner in the direction orthogonal to the axis A. The other end of the terminals 17*a* is exposed in the connector portion 12. As described above, when the wire harness is inserted into the connector portion 12, the wire harness is electrically connected with the other end of the terminals 17*a*.

The terminals 17*a* exposed on the upper surface of the light source holding portion 14 penetrates through two through holes 18 provided in the light source unit 20, and is conducted by being directly soldered to terminals 24*a* (see FIG. 6) with solder 18*a*.

Further, as illustrated in FIGS. 2, 4, and 5, in the light source holding portion 14, a metal plate 30 serving as a heat radiation member is disposed on the upper surface 19 on which the light source unit 20 is mounted. The metal plate 30 is formed integrally with the socket unit 10 so as to be exposed on the upper surface 19 of the light source holding portion 14 on which the light source unit 20 is mounted. Specifically, the metal plate 30 is bent in advance along the side wall 15 of the light source holding portion 14, the flange portion 11, the housing that is the outer shell of the socket unit 10. The metal plate 30 is disposed in a mold (to be described later), and the socket unit 10 is formed by injection molding a heat conductive resin, and then, the metal plate 30 is fixed in the socket unit 10. That is, the metal plate 30 is embedded and fixed in the heat conductive resin of the housing along the vicinity of the upper surface and the vicinity of the side surface of the light source holding portion 14, the inside of the flange portion 11, and the inside of the heat radiation fin 13.

The metal plate 30 is a member made of a metal having a heat conductance higher than that of the housing of the heat conductive resin that constitutes the outer shell of the socket unit 10, and, for example, an aluminum plate or a copper plate may be used. When improvement of heat radiation property and weight reduction of the lamp unit 100 are intended, an aluminum plate is desirable. The metal plate 30 is not limited to this shape, and may be as large as the upper surface 19 of the light source holding portion 14, or may be as large as the side wall 15 of the light source holding portion 14.

The area of the metal plate 30 positioned in the vicinity of the upper surface 19 of the light source holding portion 14 is exposed from the upper surface 19 at a surface 30*a* thereof. Then, the light source unit 20 is mounted on the surface 30*a* of the metal plate 30. When the light source unit 20 is mounted, the back surface (to be described later) of the light source unit 20 comes into contact with the metal plate 30, and the heat generated by the light emission of an LED 23 is transmitted to, for example, the housing of the heat conductive resin that constitutes the outer shell of the socket unit 10, through the circuit board 21 and the metal plate 30. Since the metal plate 30 has a heat conductance higher than that of the heat conductive resin of the housing, and is provided from the vicinity of the surface of the light source holding portion 14 to the inside of the heat radiation fin 30, it is possible to improve the heat radiation efficiency from the light source unit 20 to the heat radiation fin 13.

Figure 6:
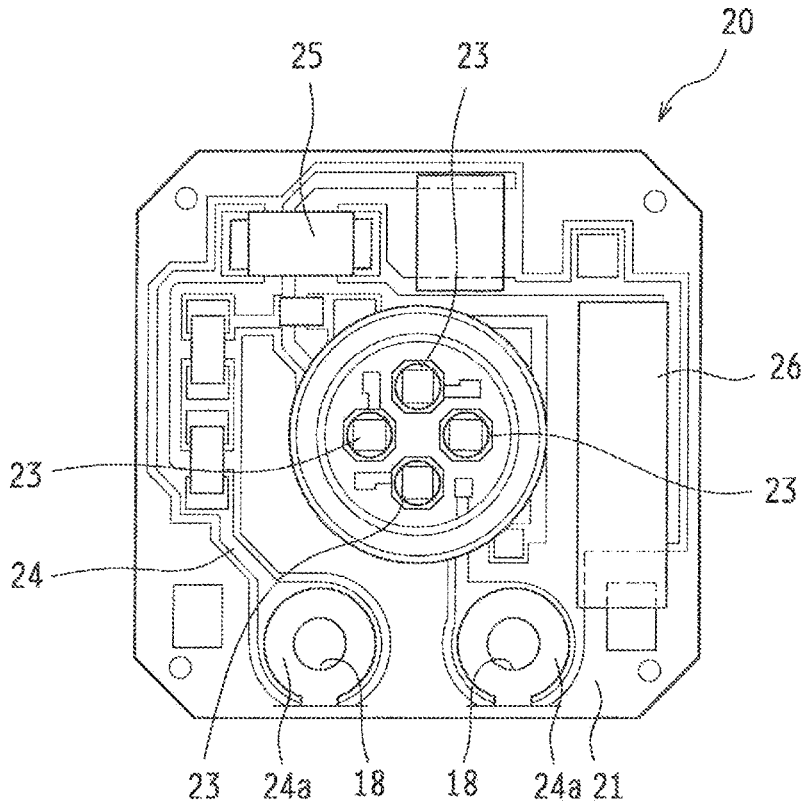
FIG. 6 is a schematic top view illustrating the light source 20 of the first embodiment.

FIG. 6 is a schematic top view illustrating the light source unit 20 of the present embodiment. The light source unit 20 includes a light emitting element constituted by a circuit board 21 and the LED 23. Here, although the example in which the LED 23 is mounted on the circuit board 21 as the light emitting element in the present disclosure, an LED package may be sorely used as the light emitting element, or an LED of a bare chip may be used as the light emitting element. Further, the example in which four light emitting elements are disposed is illustrated in FIG. 6, any number and arrangement may be used.

A wiring pattern 24 and the terminals 24*a* are formed on the upper surface of the circuit board 21, and electronic components 25 and 26 are mounted on the wiring pattern 24. In the center of the terminal 24*a*, the through hole 18 is formed penetrating the circuit board 21. A material that constitutes the circuit board 21 is not limited, and, for example, a glass epoxy resin or alumina used for a normal printed wiring board may be used. The circuit board 21 is boned to the upper surface of the light source holding portion 14 by applying a heat conductive grease or a bonding agent to the back surface side thereof.

The LED 23 is a light emitting diode that emits light of a predetermined wavelength when a voltage applied. When the lamp unit 100 is a headlight, the LED 23 emits white light, and when the lamp unit 100 is a tail lamp or a stop lamp, the LED 23 emits red light. As the LED 23 emitting white light, for example, a combination of a bare chip that emits light having a wavelength of blue to ultraviolet light as primary light and a yellow phosphor, or a combination of bare chips of each color of RGB may be used. As the LED 23 emitting red light, an AlGaInP-based LED, or a GaAs-based LED may be used. Further, some of the plurality of LEDs 23 may be used as a tail lamp, and the rest of them may be used as a stop lamp.

The wiring pattern 24 is a circuit wiring obtained by patterning a metal film formed on the circuit board 21, and the electronic components 25 and 26 are mounted thereon to constitute a driving circuit of the LED 23. A portion of the wiring pattern 24 is configured as the terminal 24*a*, and the terminal 24*a* is connected with the above-described terminal 17*a* by the solder 18*a*.

The electronic components 25 and 26 are components that constitute the driving circuit configured to drive the LED 23, and, include, for example, a resistor or a capacitor, an inductance, a transistor, or an integrated circuit (IC). The material that constitutes the circuit board 21 has a heat conductance lower than that of the material the constitutes the socket unit 10, and has a relatively low heat radiation property, and thus, it is desirable to mount by bare chip mounting or resistance printing so that the solder is not melted by heat generated by the electronic components 25 and 26. When the electronic components 25 and 26 are mounted on the circuit board 21 by solder, AuSn solder having a high melting point is desirable.

In the lamp unit 100 of the present embodiment, when a wire harness is connected to the connector portion 12 to supply power from outside, the power is supplied to the electronic components 25 and 26 from the terminal 17*a* via the terminal 24*a* and the wiring pattern 24, and the driving circuit is operated. Further, the output from the driving circuit is transmitted to the LED 23, and the LED 23 emits light.

At this time, in the light source unit 20, the electronic components 25 and 26 included in the driving circuit generate heat, and the LED 23 also generates heat. In the lamp unit 100, the heat from the light emitting element is transmitted to the heat radiation fins 13 via the light source holding portion 14, the flange portion 11, through the metal plate 30 positioned on the upper surface of the light source holding portion 14. Since the light source holding portion 14 is a part of the socket unit 10, and is made of a material having a heat conductance higher than that of the circuit board 21, the heat generated by the light emitting element is transmitted to the light source holding portion 14 better than the electronic components 25 and 26 on the circuit board 21, and is radiated through the flange portion 11 and the heat radiation fins 13.

As described above, the light source holding portion 14 radiates the heat generated by the light source unit 20 by mounting the light source unit 20 on the metal plate 30 having a high heat conductance. Therefore, when the metal plate 30 is not disposed correctly with respect to the socket unit 10, the direction of the mounted light source unit 20 is also shifted, and thus, the light distribution of the light irradiated from the lamp unit 100 is also changed.

Therefore, as illustrated in FIGS. 1 to 5, in the present embodiment, a recess 40 is provided in the light source holding portion 14 so as to follow the back surface 30*b* opposite to the surface 30*a* of the metal plate 30 serving as a light source unit 20 mounting surface, and thus, the deformation of the metal plate 30 is suppressed. The recess 40 is opened in a substantially rectangular shape on the side wall 15 positioned on the same side as the inserting port 12*a* of the connector portion 12, and extends in a cylindrical shape along the back surface 30*b* of the metal plate 30. The recess 40 has a length such that the terminal end thereof is positioned at a point out of the metal plate 30. In the present embodiment, the recess 40 is opened in the same direction as the inserting port 12*a* of the connector portion 12, and extends in parallel with the connector portion 12, but the present disclosure is not limited thereto. The opening direction or the extending direction may be different from those of the connector portion 12 as long as following the back surface 30*b* of the metal plate 30.

A width in the direction orthogonal to the direction in which the recess 40 is extending, that is, a width L in FIG. 4 may be in a range of 35% or more, and 70% or less with respect to a width 1 of the metal plate 30 in the same direction. When the width L of the cavity formed by the recess 40 is extremely narrow, the metal plate 30 is affected by shrinkage of the heat conductive resin caused by a manufacturing method (to be described later). Meanwhile, when the width L is extremely broad, the amount of the heat conductive resin that fixes the metal plate 30 in the vicinity of the light source unit mounting surface decreases, and the fixing of the metal plate 30 becomes insufficient. Further, the strength of the light source holding portion 14 is weakened, which affects, for example, durability.

Next, descriptions will be made on a manufacturing method of the socket unit 10.

Figure 7:
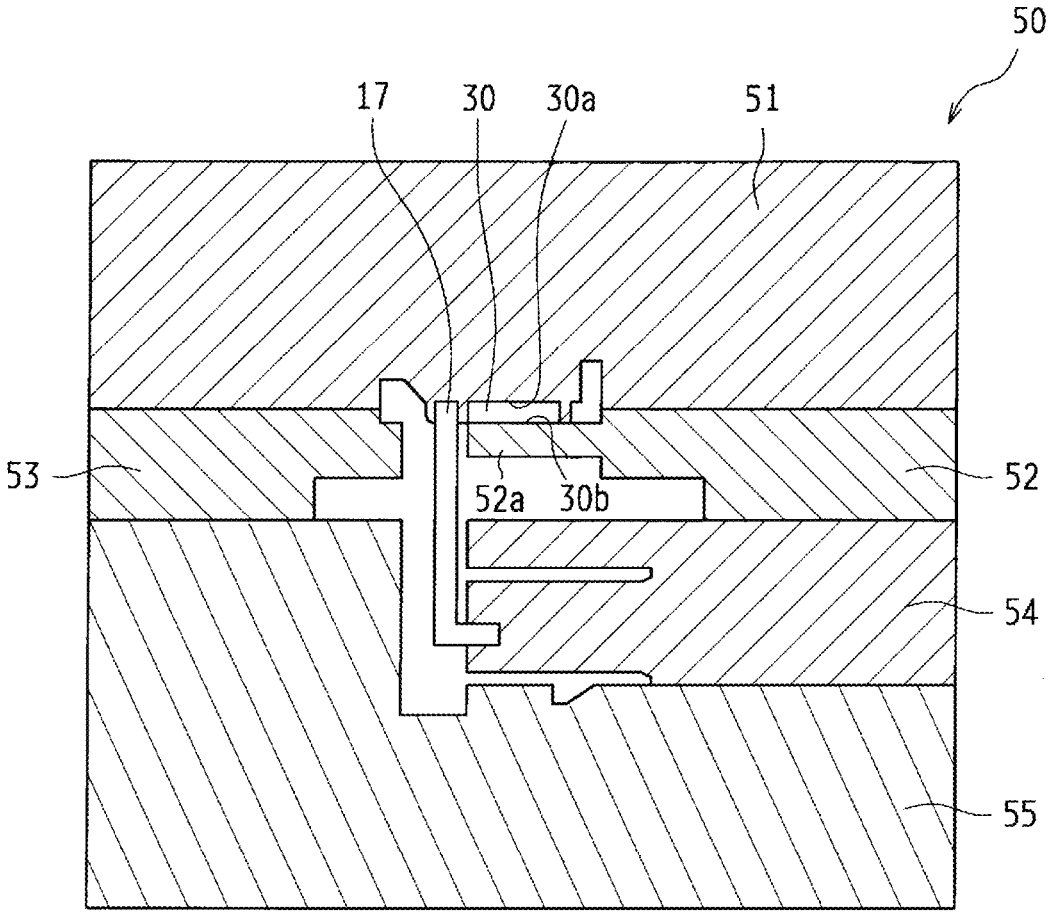
FIG. 7 is a schematic cross-sectional view illustrating a mold of a socket 10 of the first embodiment.

FIG. 7 illustrates a schematic cross-sectional view of, for example, a mold 50 when forming the socket unit 10 using the mold 50.

In the present embodiment, the mold 50 is configured by combining a plurality of members. Assuming that the light source holding portion 14 side on the axis A in FIG. 1 is upward, as illustrated in FIG. 7, the plurality of members include a first mold 51 that forms mainly the upper portion of the light source holding portion 14, a second mold 52 serving as a mold for the lower portion of the light source holding portion 14 and the flange portion 11, a third mold 53 similarly serving as a mold for the lower portion of the light source holding portion 14 and the flange portion 11, a fourth mold 54 configured to form the connector portion 12 and the heat radiation fins 13, and a fifth mold 55 configured to form the lower portion of the socket unit 10.

Here, the second mold 52 is shaped to form the outer shell of the flange portion 11 and the light source holding portion 14, and includes a protruding portion 52*a* that becomes the recess 40 formed on the back surface of the metal plate 30.

When molding the socket unit 10, first, the third mold 53, the fourth mold 54, and the fifth mold 55 are combined (outer shape preparing step). Next, the terminal holding portion 17 and the metal plate 30 are disposed in a predetermined position in the mold having the outer shape prepared as described above (metal plate preparing step). Then, the second mold 52 is combined with another mold by inserting in the direction substantially orthogonal to the axis A, such that the protruding portion 52*a* follows the back surface 30*b* of the metal plate 30. Then, the first mold 51 is combined from above (recess preparing step). When the mold 50 is assembled in this manner, a heat conductive resin is filled in the inside the mold 50 from a predetermined location (not illustrated) (filling step). The filled heat conductive resin is cured (curing step), the mold 50 is separated, and then, the socket unit 10 is completed.

As described above, since the socket unit 10 is formed by injection molding, the heat conductive resin is filled in the inside of the mold 50 with an injection pressure. Meanwhile, in the present embodiment, the protruding portion 52*a* of the second mold 52 supports the back surface 30*b* of the metal plate 30, and the first mold 51 presses the surface 30*a* of the metal plate, and thus, the metal plate 30 is fixed with sandwiched between the first mold 51 and the protruding portion 52*a* of the second mold 52. Therefore, even when the heat conductive resin is filled in the mold 50 and a pressure is applied to the inside, the metal plate 30 is fixed by the mold 50, and thus, positional shift is less likely to occur, and even if the positional shift occurs, the shift amount is extremely small.

Then, when removing the mold 50 after the formation, the portion where the protruding portion 52*a* is positioned becomes the recess 40. At the time of curing or after removing the mold 50, the heat conductive resin somewhat shrinks with the temperature change. However, the back surface 30*b* of the metal plate 30 forms a cavity together with the recess 40 and there is no heat conductive resin, and thus, distortion due to the shrinkage of the resin is suppressed.

As described above, it is possible to suppress the positional shift or the distortion of the metal plate 30 by sandwiching the metal plate 30 between the first mold 51 and the protruding portion 52*a* of the second mold 52. As a result, it is possible to suppress the occurrence of the deformation of the light source unit 20 mounting surface (the surface 30*a*). Further, even after separating the mold 50, the shrinkage of the heat conductive resin does not affect to the positional fixing of the metal plate 30 by virtue of the recess 40. In this manner, the occurrence of deformation of the metal plate 30 may be suppressed as much as possible.

In the present embodiment, as an assembling order of the mold 50, after combining the third mold 53, the fourth mold 54, and the fifth mold 55, the metal plate 30 are disposed, and then, the second mold 52 is combined, and finally, the first mold 51 is put on. However, the present disclosure is not limited to this order, and the order may be appropriately changed depending on the shape of each mold. For example, an order in which the second mold 52 is inserted lastly may be used. Further, the mold 50 is divided into five members, but the present disclosure is not limited thereto, and the number of the members may be appropriately changed according to the shape of the socket unit 10.

Further, the width of the protruding portion 52*a* of the second mold 52 is set such that, when completing the socket unit 10, the width of the recess 40 becomes the width L. As described above, when the width of the recess 40 is extremely narrow, that is, the width of the protruding portion 52*a* is extremely narrow, the back surface 30*b* of the metal plate 30 is not supported sufficiently, and thus, the positional shift of the metal plate 30 at the time of injection molding may not be suppressed. Further, when the width of the protruding portion 52*a* is extremely broad, the cavity of the recess 40 in the completed socket unit 10 becomes large, which affects the strength of the light source holding portion 14. Therefore, the width of the protruding portion 52*a* may be a width capable of supporting the metal plate 30 sufficiently, and sufficiently fixing the metal plate 30 across the first mold 51, and may be a width causing the cavity by the recess 40 to fall within an appropriate range.

In the present embodiment, although the inside of the recess 40 is used as a cavity, after the heat conductive resin is solidified and the shape of the socket unit 10 is fixed, the inside of the recess 40 may be filled with a filling member such as a resin. The resin to be filled may be the same resin as the heat conductive resin that forms the socket unit 10, or may be different from each other. When the shape of the socket unit 10 is already fixed, even if the resin filled in the recess 40 is shrunk when the resin is solidified, the metal plate 30 does not move due to the shrinkage, and thus, deformation hardly occurs on the light source unit mounting surface (the surface 30*a*) of the metal plate 30. Further, in addition to a form in which a resin is injected, a filling member that is formed in advance in the size of the recess 40 may be inserted. Then, it is desirable that the filling member has a heat conductance equal to or higher than that of the metal plate 30 because the heat radiation from the metal plate 30 may become sufficient.

Next, descriptions will be made on an assembling step of the lamp unit 100. First, the socket unit 10 formed in advance and the circuit board 21 on which a light emitting element such as the LED 23 is mounted are prepared. Subsequently, the circuit board 21 is mounted on the upper surface of the light source holding portion 14 of the socket unit 10. At this time, the circuit board 21 is mounted on the metal plate 30 and the terminal holding portion 17, and the terminal 17*a* is inserted into the through hole 18, and then, the terminal 17*a* and the terminal 24*a* are soldered by the solder 18*a* to be electrically connected with each other.

As described above, the lamp unit 100 assembled in this manner is mounted to the lamp body to form a vehicle lamp.

Second Embodiment

Next, descriptions will be made on a second embodiment of the present disclosure with reference to FIGS. 8A, 8B and 9. Descriptions of contents overlapped with the first embodiment will be omitted.

Figure 8A:
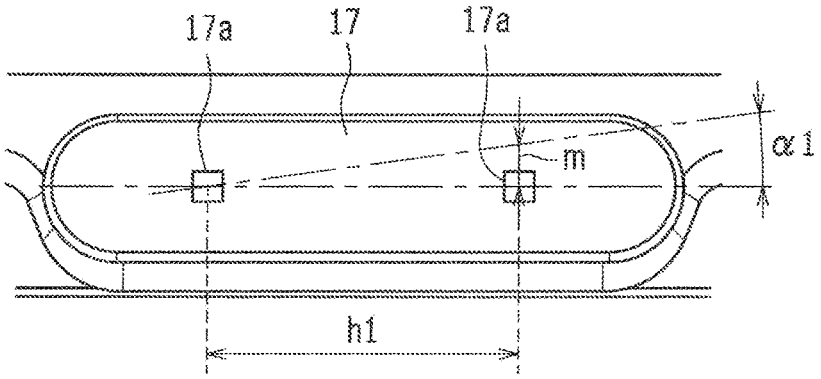
FIGS. 8A and 8B are schematic top views illustrating a terminal holding portion 17 of a second embodiment.
Figure 8B:
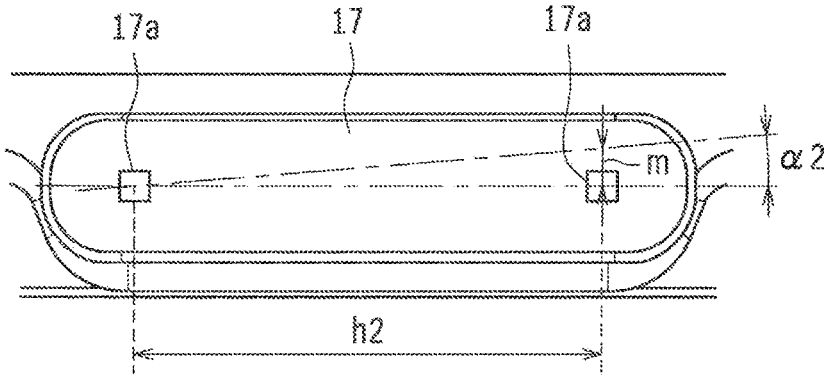

FIG. 8A is a view illustrating a terminal holding portion in the related art, and FIG. 8B is a view illustrating the terminal holding portion 17 of the present embodiment.

In the related art, in order to recognize an appropriate mounting position when loading the circuit board 21 of the light source unit 20 on the light source holding portion 14, the position of the terminal 17*a* is used as an index. Specifically, the position of each of the terminals 17*a* is recognized by capturing the terminal holding portion 17 by, for example, a camera, and using the recognized two points as the indexes, the socket unit 10 is rotated to be positioned at a predetermined reference position, and then the circuit board 21 is mounted on the positioned socket unit 10. The circuit board 21 may be rotated in accordance with the position of the recognized terminal 17*a*, and the rotated circuit board 21 may be mounted.

Figure 9:
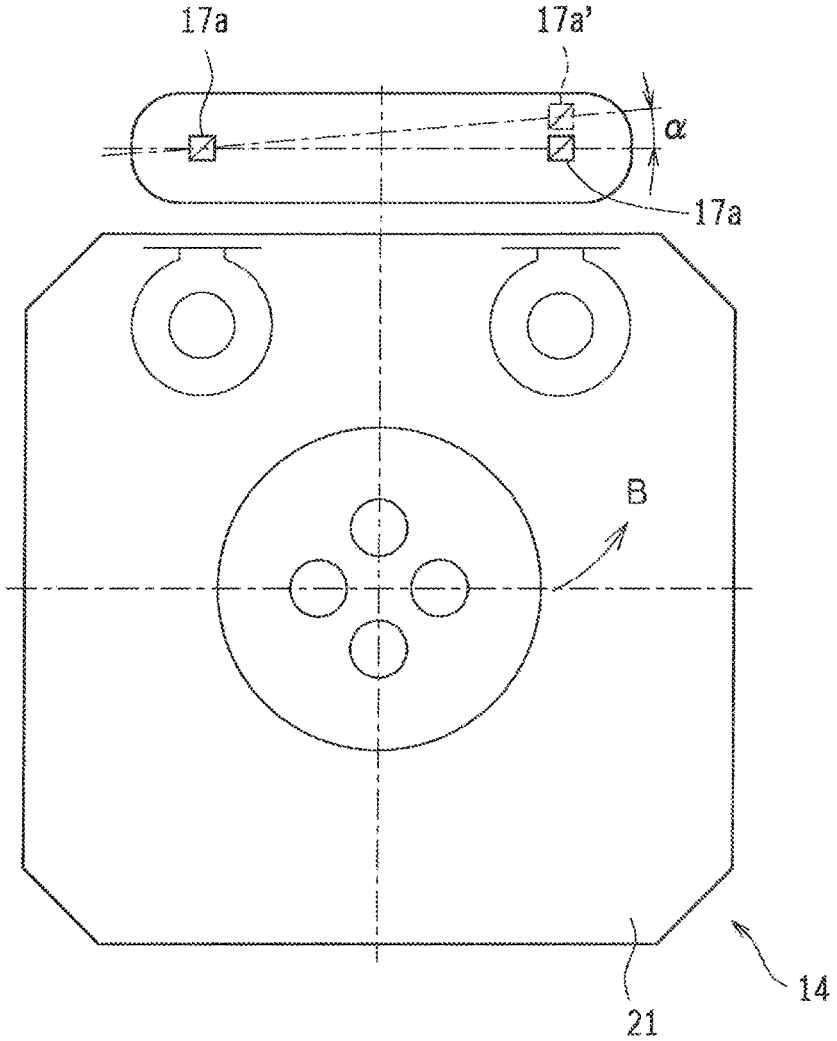
FIG. 9 is a schematic top view illustrating a light source holding portion 14 of the first embodiment.

As illustrated in FIG. 9, when one terminal 17*a* is located at a position (a position indicated by a terminal 17*a*') shifted from the original position, the straight line connecting the terminals 17*a* and 17*a*' is inclined by an angle α from the straight line connecting the original terminals 17*a* and 17*a*. When attaching the circuit board 21 by positioning using the terminal 17*a*' at the shifted position as an index, the circuit board 21 is inserted into the through hole 18 in a state of being tilted by an angle α in a direction indicated by an arrow B from a predetermined position, in other words, in a state of being inclined (rotated) by an angle α (hereinafter, also referred to as "rotational shift"), and thus, the circuit board 21 is not mounted in the appropriate position. When mounting the light source unit 20 in a state where the rotational shift of the circuit board 21 is large, a problem in that a manipulator of an assembling apparatus is interfere with the side wall 15 may occur.

In order to reduce the influence of such attaching position errors of the terminals 17*a* on the arrangement of other members such as the circuit board 21, in the present embodiment, the terminals 17*a* are disposed apart from each other farther than the related art. That is, the distance between the terminals 17*a* in the related art illustrated in FIG. 8A is a distance h1, but in the present embodiment, as illustrated in FIG. 8B, the distance between the terminals 17*a* is a distance h2 that is longer than the distance h1.

For example, in the case of the distance h1 between the terminals 17*a* in the related art, when one of the terminal 17*a* is disposed at a distance m shifted from a predetermined position, the straight line connecting the two terminals 17*a* is inclined by an angle α1 from the original straight line. Meanwhile, since the terminals 17*a* in the present embodiment are disposed farther apart from each other, even if one of the terminal 17*a* is shifted by the same distance m from the predetermined position, the inclination of the straight line connecting the two terminals 17*a* falls within an angle α2 smaller than the angle α1. Therefore, the rotational shift from the original position of the circuit board 21 disposed using the terminals 17*a* as an index falls within the angle α2. When the rotational shift is in a range that is allowable for products, as a result, the influence due to the positional shift of the terminal 17*a* may be suppressed, and thus, generation of defective products may be suppressed.

That is, in the present embodiment, by increasing the distance between the terminals 17*a* serving as an index for positioning, even if the terminals 17*a* are shifted, the influence due to the shift on the positioning of other members is reduced as compared with the related art, and the generation of defective products is suppressed, and thus, the production yield is improved as a result.

The positioning method of the circuit board 21 is not limited to the above method, and any method may be used as long as the method uses the positional relationship between the circuit board 21 and the two terminals 17*a*. For example, a method in which the respective two terminals 17*a* are positioned at positions at a predetermined distance from the center of the circuit board 21 may be used.

Third Embodiment

In the first embodiment, the protruding portion 52*a* of the second mold 52 that forms the recess 40 has a flat shape. In the present embodiment, as illustrated in FIGS. 10A and 10B, the surface of protruding portions 52*b* and 52*c* of the mold 52 that comes into contact with the back surface 30*b* of the metal plate 30 does not have a flat shape.

Figure 10A:
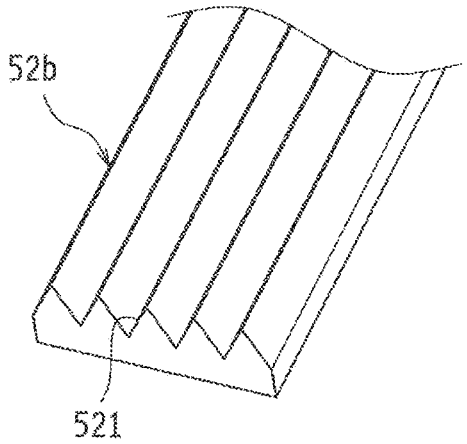
FIGS. 10A and 10B are schematic partial perspective views illustrating a protruding portion of a second mold 52 of a third embodiment.
Figure 10B:
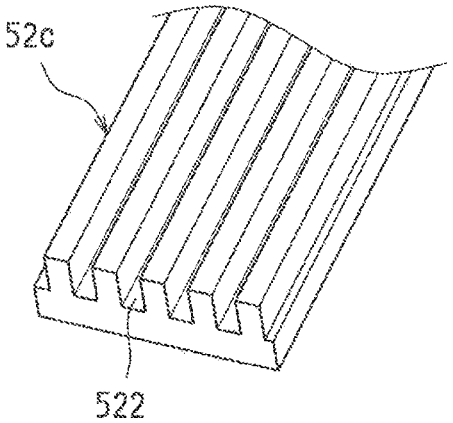

As illustrated in FIG. 10A, the surface of the protruding portion 52*b* that is in contact with the metal plate 30 has a plurality of V-shaped grooves 521 such that the grooves are arranged in the width direction of the protruding portion 52*b*. Further, as illustrated in FIG. 10B, the protruding portion 52*c* has a plurality of grooves 522. As described above, the contact surface may have irregularities.

In the protruding portions 52*b* and 52*c* having irregularities, the back surface 30*b* of the metal plate 30 and the grooves are not brought into contact with each other. However, there is no problem in supporting the metal plate 30, and the positional shift of the metal plate 30 at the time of the injection molding of the socket unit 10 is effectively suppressed. At the time of the injection molding, the heat conductive resin enters into the groove portions, and after the resin is cured, a plurality of convex portions due to the resin are disposed on the back surface of the metal plate 30. As described above, since the irregularities are formed on the back surface of the metal plate 30, the surface area of the heat conductive resin increases, which is effective for heat radiation.

The present disclosure is not limited to the respective embodiments described above, and various modifications are possible within the scope described in the claims. Embodiments obtained by appropriately combining technical means disclosed respectively in different embodiments are also included in the technical scope of the present disclosure.

This international application claims priority based on Japanese Patent Application No. 2018-007287, filed on Jan. 19, 2018, and the disclosure of Japanese Patent Application No. 2018-007287 is incorporated in this international application in its entire contents by reference.

The above descriptions on the specific embodiments of the present disclosure are presented for purposes of illustration. The descriptions are not intended to be exhaustive or to limit the present disclosure to the precise form as described. It will be apparent to those skilled in the art that various modifications and variations are possible in light of the above descriptions.

DESCRIPTION OF SYMBOLS

100: lamp unit
10: socket
11: flange portion
12: connector portion
13: heat radiation fin
14: light source holding portion
15: side wall
16: engaging portion
17: terminal holding portion
17*a* and 24*a*: terminal
18: through hole
18*a*: solder
19: upper surface of light source holding portion
20: light source
21: circuit board
23: LED
24: wiring pattern
25 and 26: electronic component
30: metal plate (heat radiation member)
30*a*: surface of metal plate (light source unit mounting surface)
30*b*: back surface of metal plate
40: recess
50: mold
51: first mold
52: second mold
52*a*: protruding portion
52*b*: protruding portion (another example)
52*c*: protruding portion (another example)
53: third mold
54: fourth mold
55: fifth mold

What is claimed is:

1. A lamp comprising:
a light source; and
a socket on which the light source is mounted,
wherein the socket includes a light source holder that holds the light source, and a connector that supplies power to the light source,
the light source holder includes a housing, metal plate embedded in the housing, and a recess,
the metal plate has a light source mounting surface and a back surface opposite the light source mounting surface, and
the recess extends between an upper surface of the light source holder and the back surface of the metal plate from an outside to a portion immediately below the light source.

2. The lamp according to claim 1, wherein the housing of the light source holder is made of a heat conductive resin, and
the light source is mounted on the light source mounting surface of the metal plate, and the light source mounting surface is partially exposed from the housing.

3. The lamp according to claim 2, wherein the back surface of the metal plate is exposed in the recess.

4. The lamp according to claim 2, wherein a width of the recess in a direction parallel to the metal plate and different from a direction in which the recess extends is in a range of 35% to 70% with respect to a width of the metal plate in the same direction.

5. The lamp according to claim 1, wherein the connector extends in a first direction intersecting a mounting direction of the light source in the socket.

6. The lamp according to claim 5, wherein the direction in which the recess extends is substantially the same as the first direction.

7. The lamp according to claim 5, wherein the first direction is a direction orthogonal to the mounting direction of the light source.

8. The lamp according to claim 1, wherein a filling member is disposed in the recess.

9. The lamp according to claim 1, wherein the connector extends in a first direction and the recess extends along a direction parallel to the first direction.

10. The lamp according to claim 1, further including a terminal facing a first direction and the recess extends along a direction parallel to the first direction.

11. The lamp according to claim 1, further comprising a terminal holder having a first terminal and second terminal opposite the first terminal,
wherein the first terminal is configured to contact the light source, the second terminal faces a first direction, and the recess extends along a direction parallel to the first direction.

12. A method for manufacturing a lamp, the method comprising:
preparing an outer shape mold to form an outer shape of a light source holder and a socket;
preparing a metal plate, the metal plate having a light source mounting surface and a back surface opposite the light source mounting surface, to dispose the metal plate inside the outer shape mold,
preparing a recess mold extending to a portion immediately above an upper surface of the light source holder and immediately below the back surface of the metal plate;
filling an inside of the outer shape mold with a heat conductive resin; and
curing the heat conductive resin.

* * * * *